United States Patent [19]

Mosser et al.

[11] Patent Number: 4,489,670

[45] Date of Patent: Dec. 25, 1984

[54] FIXTURE FOR CENTRIFUGAL APPARATUS

[75] Inventors: Mark F. Mosser, Sellersville; Bruce G. McMordie, Philadelphia; William J. Fabiny, Harleysville, all of Pa.

[73] Assignee: Sermetel, Limerick, Pa.

[21] Appl. No.: 495,047

[22] Filed: May 16, 1983

[51] Int. Cl.[3] ..... B05C 7/00; B05C 11/08

[52] U.S. Cl. ..... 118/55; 118/52; 209/915

[58] Field of Search ..... 118/52, 53, 54, 55, 118/716; 209/915, 680, 689

[56] References Cited

U.S. PATENT DOCUMENTS 2,054,155 9/1936 Dulken ..... 118/55 X 3,429,295 2/1969 Shapiro ..... 118/52 X

*Primary Examiner*—John P. McIntosh

*Attorney, Agent, or Firm*—Weiser & Stapler

[57] ABSTRACT

A means for use with a work basket of centrifugals utilized in dipspin coating processes for orienting parts, and the combination therewith.

36 Claims, 13 Drawing Figures

FIXTURE FOR CENTRIFUGAL APPARATUS

FIELD OF THE INVENTION

The present invention relates to an improvement in centrifugal apparatuses which are utilized in connection with the coating of parts. More particularly, the invention is concerned with a means for orienting parts in a centrifugal apparatus during the spinning operation in order to obtain a uniform coating after they have been dipped into a coating composition.

BACKGROUND OF THE INVENTION

For quite some time, irregularly shaped parts have been coated by centrifugal techniques known as dip/-spin or Filwhirl processing. In these batch processes, parts are loaded into a basket made of metal screen or perforated metal. In the dip/spin process, the basket of parts is dipped into a tank or vat of coating liquid. After immersion, the basket is raised, allowed to drain momentarily and then spun at speeds of typically 80 to 550 RPM. During spinning, excess coating is thrown from the parts until only a uniform thin film remains. The surplus coating is collected and returned to the coating bath. The Filwhirl process is identical to dip/spinning except that the coating is pumped into the basket until all the parts are flooded. Then the liquid is drained and the basket of parts is spun at 900 to 1,200 RPM.

A wide variety of parts, including coiled springs, screws, fasteners and much more are coated by the centrifugal methods described above. The technique eliminates time consuming handling of individual parts and ensures optimum utilization of coating.

However, until the present invention it has not been possible to uniformly coat nuts, or other parts with similar symmetries such as bushings, bearing sleeves, electrical meter yokes, etc. by the dip/spin or Filwhirl processes. In these batch processes parts are randomly oriented in the basket. However, unless the hole in a nut or other center-bored part is oriented parallel to the line of action of the centrifugal force generated during spinning, excess coating will accumulate along one wall of the internal diameter and the coating thickness in the center hole will exceed allowable tolerances.

It is therefore an object of the present invention to provide a means for separating and orienting parts during the spin cycle of the dipspin or Filwhirl coating method so as to result in improved coated parts.

It is a further object to provide a means for automatically separating and orienting certain center-bored parts, especially certain nuts and threaded female fasteners, during the spin cycle of a dip/spin or Filwhirl process in order to obtain a uniform coating on internal surfaces.

In general, the present invention relates to orientation means for centrifugals. More particularly the invention relates to an insert for the work basket or container of centrifugals which will orient parts therein. The objectives of the present invention can be achieved by providing in combination with the container or work basket of a centrifugal, means for orienting the parts within the container comprising an inner member fixed for rotation with the container for initially receiving the parts and at least one apertured or screen member circling the inner member and forming at least one compartment around the inner member between the side wall of the container and the inner member. The inner member which is fixed for rotation with the container is spaced from the top of the container so as to permit parts to pass and is sloped so as to permit centrifugal force to carry the parts therein out of the inner member as a result of centrifugal force during a spinning cycle. The apertured member is spaced from the top of the container and forms a compartment with the wall of the container which has a size so as to receive and orient a part therein in a direction in accordance with the shape or size of the part.

More specifically, the invention described herein provides a means to automatically separate and orient certain center-bored parts during the spin cycle of a dip/spin or Filwhirl coating machine in order to obtain a uniform coating on internal surfaces. Ordered orientation of the parts is accomplished by means of a hollow cone-like member that is inserted into the centrifugal basket or container. Typically, the basket is a canister made of metal screening or heavy mesh surrounded by a reinforced frame. The conical insert may be non-apertured but is preferably made of metal screening, [or] mesh or perforated metal and its maximum diameter is slightly smaller than that of the basket's wall. The smaller end of this cone-like member is preferably attached to the center of the floor of the centrifuge basket. Around the perimeter of this cone, from the floor of the basket straight up to the top edge of the cone, may be attached or integral therewith, a metal support of screening or heavy mesh forming the outer member. The distance between this supporting wall and the inner wall of the basket is preferably chosen to be greater than the thickness of the part to be coated, yet also less than the smallest diameter of said part. The orienting means of invention most preferably consists of an inverted cone enclosed in a cylinder such that the cross-section of the device has the shape like the letter "M".

The distance between the outermost cylindrical wall of the orienting device and the basket wall is preferably set to be greater than the thickness of the part to be coated, but also less than the smallest diameter of said part. This spacing is advantageous to the function of the invention because, during operation, properly oriented parts become trapped in the compartment or slot.

Parts are loaded directly into the cone portion of the insert. As the basket accelerates during the spin cycle, the parts move up the cone's wall as they are forced toward the outer walls by centrifugal forces. When the parts reach the top of the cone, those that are oriented with center holes parallel to the line of the centrifugal force will fall into the compartment or slot formed by the supporting wall or outer member of the insert and the wall of the basket. When the basket stops, that portion of the load that was not properly aligned, falls back down into the cone, but properly oriented parts remain trapped in the compartment or slot. Starting and stopping the basket again forces more parts into the slot, and eventually (usually after only several pulses) the entire load can be preferentially oriented in this manner.

These and other objects and features of the present invention will become apparent from the following description taken in conjunction with preferred embodiments thereof with reference with the accompanying drawings, in which:

BRIEF DESCRIPTION OF THE DRAWINGS

With reference to the drawings, FIGS. 1 and 3 illustrate a conventional container 10 which is utilized in connection with centrifugal coating apparatuses. The conventional containers are usually metallic frames having an outside support for a mesh lining. Mesh is the preferred lining because it permits passage of the greatest volume of air for rapid drying. The mesh size is selected to retain the smallest part. A conical lip 12 at the top of the container 10 retains the parts during rotation. For purposes of illustration only, there is shown one form of a conventional general purpose type container. However, the present invention can be practiced utilizing other forms of containers including conical containers, dump-bottom containers, and the like. type shown in FIG. 2 is fixed centrally in the container 10. The inner member 13 may be either permanently fastened to the base 15 of the container 10 or removable as shown in the drawings. One means for permitting the inner member to be removable is by providing a threaded engaging means 16 on the base of the container which receives a threaded base portion 13*a* of the inner member 13. Associated with the inner member 13 is a screen or apertured member 17. The apertured member 17 circles the inner member 13 so as to form a slot or compartment a with the wall 18 of the container 10. The inner member 13 and the apertured outer member 17 of the orienting means may either be integral with one another or comprised of two separate members.

FIGS. 4A and 4B show the motion that the parts shown in FIG. 3 undergo during the spin cycle of the coating processes. Centrifugal forces push the nuts outward and upward along the conical portion of the insert 13. Upon reaching the top of the sloped wall, certain nuts 14*a* topple into the space between the outer wall of the insert 13 and the inner wall of the basket 18. These nuts are now oriented with faces normal to the line of centrifugal force generated during spinning. When the parts are in this attitude, excess coating will evacuate the threaded hole and tolerances will be maintained. Nuts 14*b* which are standing on end when at the top of the insert will not fall into the slot or compartment. When the basket stops, these improperly oriented parts will roll back down the sloped wall into the center of the centrifuge basket. When the basket accelerates again, many of those nuts not yet in the slot will reorient themselves and become trapped with the others. After several cycles of starting and stopping the basket, all the parts will be positioned in the desired orientation.

Figure 2:
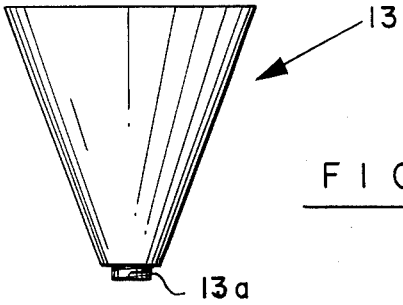
FIG. 2 is a side view of one type of orienting means of the invention.
Figure 1:
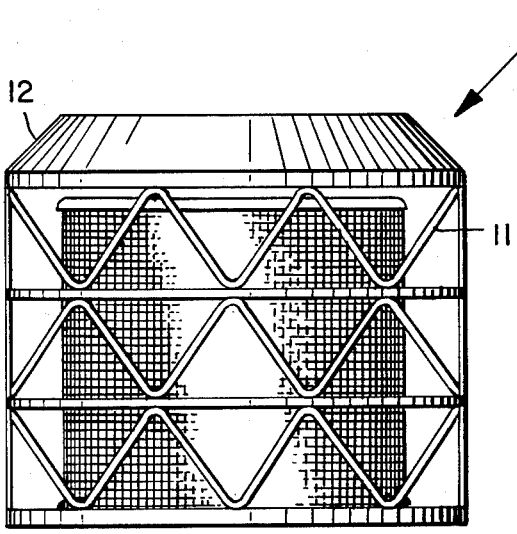
FIG. 1 is a side view of a centrifugal container utilized in combination with the orienting means of the present invention.
Figure 4A:
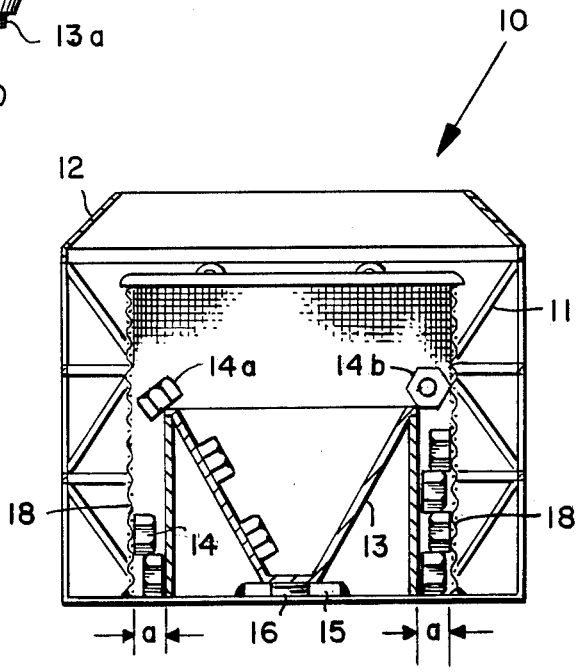
FIGS. 4A and 4B illustrate the invention under centrifugal force.
Figure 3:
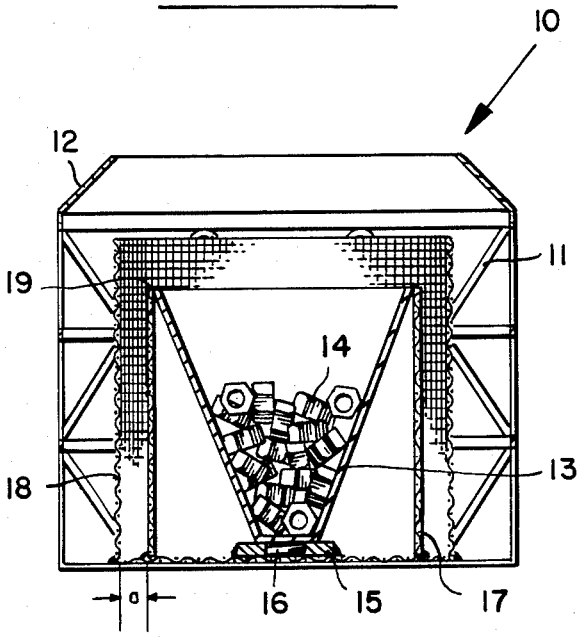
FIG. 3 is a cross-sectional view of the container of FIG. 1 with the orienting means of FIG. 2.
Figure 4B:
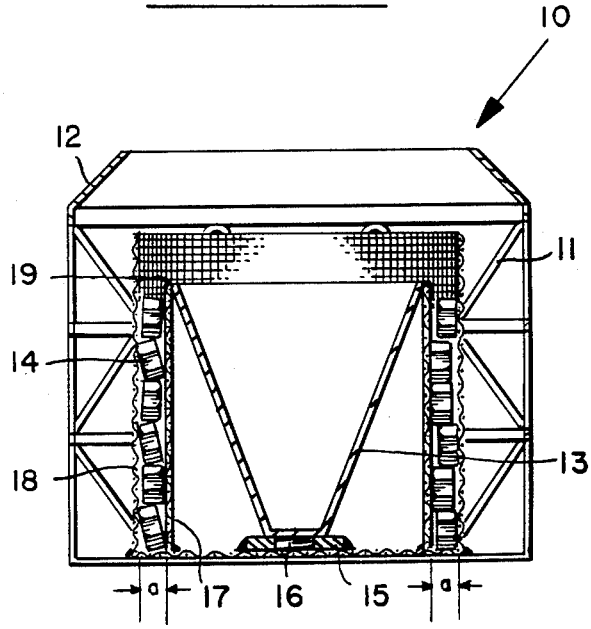

As further seen in FIGS. 4A and 4B, the inner member 13 may be provided with a lip 19 for supporting a separable apertured member 17 during a spin cycle. The apertured member 17 when separate from the inner member 13 may either be permanently affixed in the container 10 or be removably attached to the base of the container 10. When the member 17 is removably attached, it is contemplated by the present invention to be able to utilize apertured members having different diameters so as to be capable of varying the size of the compartment a which is formed with the wall 18 of the container 10.

FIG. 4B illustrates the container 10 of FIG. 4A during a spin cycle after orienting wherein the parts 14 have moved up the slope of the inner member 13 and are oriented in the compartment a as a result of their shape and size during the spin cycle. The orientation of parts is especially critical for those parts having internal threads. Parts such as nuts must be fixtured with the hole facing outward in the container 10 in order to accomplish a coating of the threads on the nuts and hold tolerances on those surfaces. When the nuts are oriented as shown, the excess coating will be spun out of the threads. Otherwise, the coating will build up on a line, filling the threads and preventing a proper fit of the part where intended.

FIGS. 5A–5D illustrate that the width a of the compartment is preferably somewhat greater than width H of the nut in order to accommodate not having a rectangular shape H width by G length. When the above conditions are met, properly oriented parts will be smoothly and rapidly deposited into the compartment.

Figure 5A:
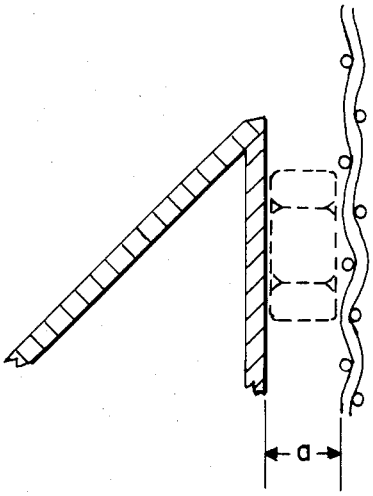
FIGS. 5A–5D show the dimensions of parts to be coated in relationship to the compartments of FIGS. 4A and 4B.
Figure 5B:
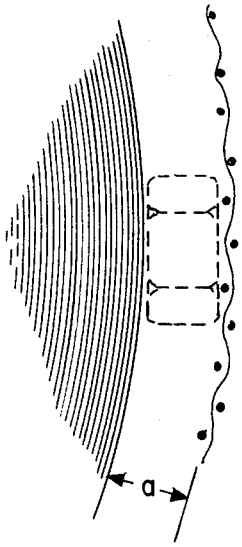
Figure 5C:
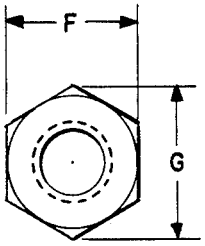
Figure 5D:
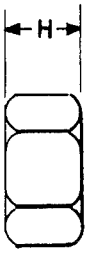

The spacing between the insert 13 and the basket wall 18 is one of the factors which promotes the effectiveness of this invention. Two views of this sized compartment are shown in FIGS. 5A and 5B, along with a standard hexagonal nut. It is preferable that in this invention, the width a of the compartment between the outer wall of the insert 13 and the basket wall 18, is not only greater than about the thickness H of the nut, but also about less than the smaller width of the nut, the face to face distance F. However, it is also preferable to account for the curvature of the basket when designating the insert.

It is obvious from the description of FIGS. 5A–5D that the invention described herein is applicable to a substantial majority of hexagonal and square headed nuts and other threaded female fasteners as well as many other sleeves, bushings and large washers which could not be centrifugally coated heretofore.

Figure 6:
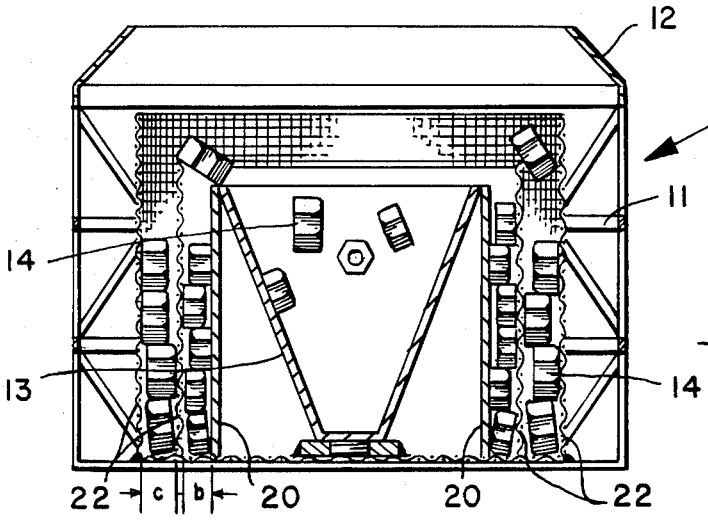
FIG. 6 further illustrates the orienting feature of the present invention.

FIG. 6 shows the container 10 having an inner member fixed therein which is encircled by two apertured members 20 and 22 which form two compartments b and c. Through utilization of a plurality of compartments, it is possible to more effectively coat a greater number of parts during the spinning cycle. Additionally, by having different widths for the compartments b and c, it is possible to orient and partially classify at least one of two or more different sized parts. FIG. 6 illustrates the container during a spin cycle wherein the parts are moving up to the slope of the inner member and are being oriented in the two compartments b and c. It may be required to utilize intermittent speeds or several spin cycles to orient the parts into the compartments.

Figure 7:
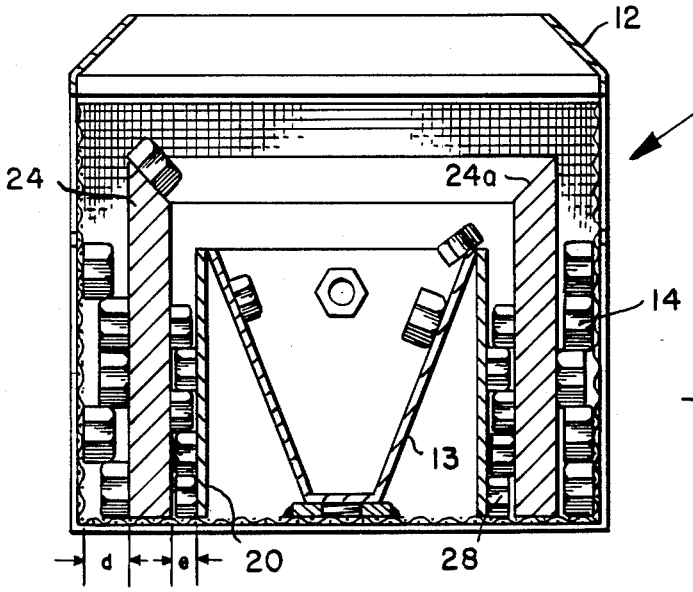
FIG. 7 illustrates a further form of orienting means of the invention.

In FIG. 7 there is shown the container of FIG. 6 wherein the apertured member 22 is replaced by a thicker apertured member 24 which possesses a sloped portion 24a that facilitates movement of the parts into the compartment d formed with the wall of the container. It can be seen that only the smaller parts 28 enter the compartment e which is formed between member 24 and member 20.

Figure 8:
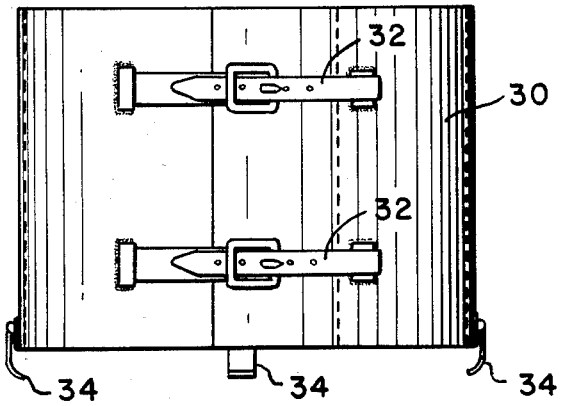
FIG. 8 shows an adjustable orienting means of the invention.

In FIG. 8, there is illustrated one form of an adjustable apertured member 30 which may be utilized in the container 10. The member 30 is provided with means 32 for adjusting the diameter of the member and thereby varying the size of the compartment which it forms. Holding means 34 is provided which permits the apertured member 30 to be fixed in the container 10 for rotation in a spin cycle.

Figure 9:
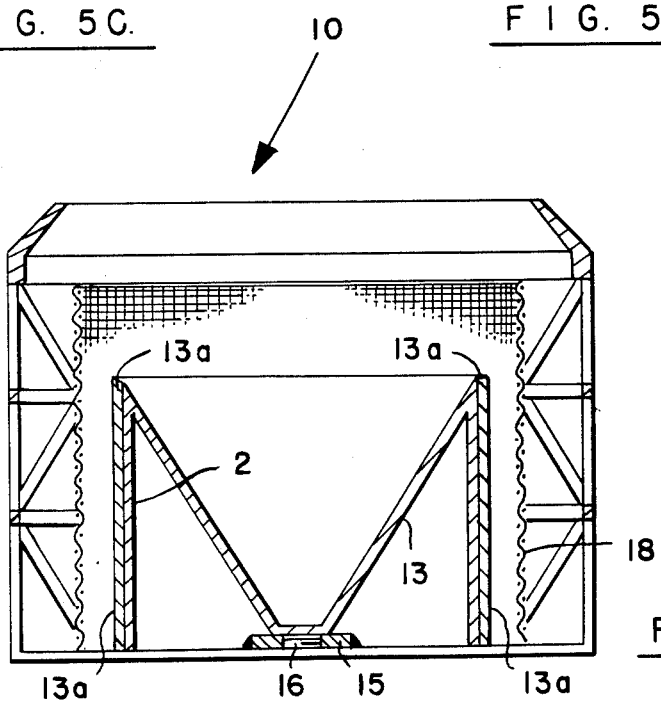
FIG. 9 illustrates a further embodiment of the present invention showing a means for altering the compartment dimensions.

It is also apparent from FIGS. A–D that the dimension a of the slot may vary with the size of the part being coated. This means that it may be necessary to utilize an insert whose size can vary or to utilize several size inserts which can be interchanged in the dip/spin basket. It is possible to adapt fixtures to accommodate more than one size part by placing cylindrical spacing rings 13A within the basket to reduce the size of the slot. FIG. 9 illustrates one method how the invention can be modified to accommodate smaller parts than originally intended by inserting a spacing apertured cylinder 13A between the outer wall of the insert 13 and the basket wall 18.

The inner member which is utilized in connection with the present invention is sloped so as to permit the parts to move out as a result of the centrifugal force during the spin cycle. Therefore the slope which is utilized is generally dependent upon the speed of the centrifuge. A slope of 20°–70°, preferably 35°–55°, has been found to be effective in conventional centrifugals. Furthermore, while the inner member is preferably apertured or of screen material, it need not be so since the coating material which may accumulate is also removed during the spin cycle.

Depending upon the material by which it is made, or whether the inner member and apertured member are integral and/or permanently affixed to the base of the container, reinforcing means may be utilized. Instead of varying the diameter of the apertured member encircling the inner member, the size and slope of the inner member may be varied in order to arrive at a suitable compartment width.

When the parts are of different sizes, the smaller and lighter parts usually move up the sloped walls of the inner member first due to the greater effect of the centrifugal force at lower speeds.

To facilitate the removal of excess coating, the orienting means of the present invention may be coated, such as with Teflon or other plastics, to provide a slippery surface.

The apparatus of the present invention has been found to be particularly advantageous when coating square and hex nuts such as defined by American National Standard, ANSI, B1.1. It is particularly useful to those geometries wherein the thickness of the bored part is smaller than its smallest external diameter or dimension. Nevertheless, the technique described herein is applicable to a substantial majority of hexagonal head nuts and threaded female fasteners as well as many other sleeves, bushings and large washers which could not be centrifugally coated heretofore.

We claim:

1. Means adapted for insertion into a container of a centrifugal apparatus used in coating a plurality of parts, and capable of orienting said parts within said container, said means comprising:

an inner member adapted for fixed rotation with said container and for initially receiving said parts, said inner member being sloped so as to permit centrifugal forces to carry said parts out of said inner member during a spinning cycle and terminating at an edge spaced from top portions of said container so as to permit parts to pass said edge during said spinning cycle, and at least one apertured member depending from the edge of said inner member and surrounding said inner member so as to form at least one compartment between side walls of the container and said apertured member, said compartment having a size capable of receiving and orienting said parts according to size or shape of said parts.

2. The means of claim 1 wherein said inner member is conical.

3. The means of claim 2 wherein said inner member has a slope of about 20° to about 70°.

4. The means of claim 3 wherein said inner member has a slope of about 35° to about 55°.

5. The means of claim 1 wherein said inner member is apertured.

6. The means of claim 1 wherein at least one apertured member is integral with said inner member.

7. The means of claim 1 wherein at least one apertured member is separate from said inner member.

8. The means of claim 7 wherein at least one separate apertured member is adjustable to size so as to vary the width of the compartment to be formed therewith.

9. The means of claim 1 wherein two apertured members circle said inner member so as to form two compartments.

10. The means of claim 9 wherein said two compartments are concentric and located between said inner member and said side walls of the container.

11. The means of claim 10 wherein said compartments have different widths, whereby parts of different size may be classified.

12. The means of claim 1 including means for removably inserting said orienting means in said container.

13. The means of claim 1 including means for altering the size of said compartment.

14. The means of claim 13 wherein said means for altering the size comprises an apertured cylinder.

15. The means of claim 14 wherein the means for altering the size comprises a segmented cylinder having diameter adjustment means associated therewith.

16. The means of claim 14 wherein the means for altering the size comprises an insert adapted for insertion over the apertured member of the inner member.

17. The means of claim 1 wherein the parts comprise a solid body portion and an aperture extending through said body portion, and wherein said compartment receives said parts so that the apertures of said parts are substantially radially aligned with said container.

18. In a container for a centrifugal apparatus adapted for use in coating a plurality of parts, the improvement which comprises means in said container for orienting said parts within said container comprising:

an inner member fixed for rotation with said container and for initially receiving said parts, said inner member being sloped so as to permit centrifugal forces to carry said parts out of said inner member during a spinning cycle and terminating at an edge spaced from top portions of said container so as to permit parts to pass said edge during said spinning cycle, and at least one apertured member depending from the edge of said inner member and surrounding said inner member so as to form at least one compartment between side walls of the container and said apertured member, said compartment having a size capable of receiving and orienting said parts according to size or shape of said parts.

19. The container of claim 18 wherein said inner member is conical.

20. The container of claim 19 wherein said inner member has a slope of about 20° to about 70°.

21. The container of claim 20 wherein said inner member has a slope of about 35° to about 55°.

22. The container of claim 18 wherein said inner member is apertured.

23. The container of claim 18 wherein at least one apertured member is integral with said inner member.

24. The container of claim 18 wherein at least one apertured member is separate from said inner member.

25. The container of claim 24 wherein at least one separate apertured member is adjustable to size so as to vary the width of the compartment formed therewith.

26. The container of claim 18 wherein at least two apertured members form two compartments within said container.

27. The container of claim 26 wherein said compartments are concentric and located between said inner member and said side walls of the container.

28. The container of claim 27 wherein said compartments have different widths, whereby parts of different size may be classified.

29. The container of claim 18 wherein said orienting means is removable.

30. The container of claim 18 including a means for altering the size of said compartment.

31. The container of claim 30 wherein said means for altering the size of the compartment is an apertured cylinder.

32. The container of claim 31 wherein the means for altering the size comprises a segmented cylinder having diameter adjustment means associated therewith.

33. The container of claim 31 wherein the means for altering the size comprises an insert adapted for insertion over the apertured member of the inner member.

34. The container of claim 18 wherein the parts comprise a solid body portion and an aperture extending through said body portion, and wherein said compartment receives said parts so that the apertures of said parts are substantially radially aligned with said container.

35. In a container for a centrifugal apparatus adapted for use in coating a plurality of parts, the improvement which comprises means in said container for orienting said parts within said container during a spin cycle, said orienting means comprising:

a conical apertured inner member centrally located within and fixed for rotation with said container, for initially receiving said parts, said inner member being sloped so as to permit centrifugal forces to carry said parts out of said inner member during a spinning cycle and terminating at an edge spaced from top portions of said container so as to permit parts to pass said edge during said spinning cycle, and an apertured outer member integral with and surrounding said inner member so as to form a compartment with inner walls of the container, said compartment having a size capable of receiving and orienting said parts according to size or shape of said parts.

36. The container of claim 35 wherein the parts comprise a solid body portion and an aperture extending through said body portion, and wherein said compartment receives said parts so that the apertures of said parts are substantially radially aligned with said container.

* * * * *